US009774077B2

(12) United States Patent
Starke et al.

(10) Patent No.: US 9,774,077 B2
(45) Date of Patent: Sep. 26, 2017

(54) ELECTROMAGNETIC HIGHLY TRANSPARENT RADOME FOR MULTI-BAND APPLICATIONS AND WIDEBAND APPLICATIONS

(71) Applicant: AIRBUS DEFENCE AND SPACE GMBH, Ottobrunn (DE)

(72) Inventors: Peter Starke, Ottobrunn (DE); Kay W. Dittrich, Ingolstadt (DE); Clemens Brand, Geisenfeld (DE)

(73) Assignee: AIRBUS DEFENCE AND SPACE GMBH, Ottobrunn (DE)

( * ) Notice: Subject to any disclaimer, the term of this patent is extended or adjusted under 35 U.S.C. 154(b) by 176 days.

(21) Appl. No.: 14/682,375

(22) Filed: Apr. 9, 2015

(65) Prior Publication Data

US 2015/0295306 A1 Oct. 15, 2015

(30) Foreign Application Priority Data

Apr. 10, 2014 (DE) ..... 10 2014 005 299

(51) Int. Cl.

| | |
|---|---|
| ***H01Q 1/42*** | (2006.01) |
| ***H01Q 1/36*** | (2006.01) |
| *H01Q 1/24* | (2006.01) |
| *H01Q 1/28* | (2006.01) |

(52) U.S. Cl.

CPC ..... *H01Q 1/422* (2013.01); *H01Q 1/36* (2013.01); *H01Q 1/42* (2013.01); *H01Q 1/24* (2013.01); *H01Q 1/28* (2013.01)

(58) Field of Classification Search

USPC ..... 343/872, 897

See application file for complete search history.

(56) References Cited

U.S. PATENT DOCUMENTS

| | | | | |
|---|---|---|---|---|
| 3,002,190 | A | 9/1961 | Oleesky et al. | |
| 4,358,772 | A | 11/1982 | Leggett | |
| 7,151,504 | B1 * | 12/2006 | Boatman ..... | H01Q 1/422 343/872 |
| 7,420,523 | B1 | 9/2008 | Ziolkowski et al. | |

FOREIGN PATENT DOCUMENTS

| | | |
|---|---|---|
| DE | 24 41 540 | 3/1976 |
| GB | 2 075 269 | 11/1981 |

OTHER PUBLICATIONS

European Search Report conducted in counterpart Europe Appln. No. EP 15 00 0944 (Aug. 24, 2015).

* cited by examiner

*Primary Examiner* — Jessica Han
*Assistant Examiner* — Hai Tran
(74) *Attorney, Agent, or Firm* — Greenblum & Bernstein, P.L.C.

(57) ABSTRACT

A radome having a core layer and two cover layers and method of forming the radome. The core layer is arranged between the two cover layers. Each of the two cover layers is composed of a plurality of partial layers which, by their respective dielectric constant, are embodied such that the radome provides a high mechanical stability and a high electromagnetic transparency. The dielectric constant of adjacent partial layers thereby alternates from relatively high to relatively low in the direction towards the core layer, and vice versa.

20 Claims, 2 Drawing Sheets

ELECTROMAGNETIC HIGHLY TRANSPARENT RADOME FOR MULTI-BAND APPLICATIONS AND WIDEBAND APPLICATIONS

CROSS-REFERENCE TO RELATED APPLICATIONS

The present application claims priority under 35 U.S.C. §119 of German Patent Application No. DE 10 2014 005 299.0, filed Apr. 10, 2014, the disclosure of which is expressly incorporated by reference herein in its entirety.

BACKGROUND OF THE EMBODIMENTS

1. Field of the Invention

The invention relates to a radome for a transmitter/receiver unit.

2. Discussion of Background Information

Protective coverings for transmitter/receiver units, in the form of, e.g., antennas, are referred to as a radome. A radome is preferably embodied as a closed protective covering and is used to protect an antenna from external influences or environmental influences, such as wind or rain, for example. In general, these environmental influences can be referred to as mechanical and/or chemical influences.

A radome essentially handles two tasks: mechanical stability for shielding against mechanical influences and electromagnetic transparency, i.e., permeability to electromagnetic waves, so that an antenna can fulfill its purpose as a transmitter/receiver unit without a received or sent electromagnetic signal experiencing an undesired attenuation or any other disturbance, for example.

The requirements for mechanical stability and electromagnetic transparency can lead to diametrically opposed design results, i.e., the electromagnetic transparency can be negatively affected as mechanical stability increases and vice versa.

In the prior art, it can be necessary that the design of a radome must be modified depending on the antenna frequencies used, or that the working frequencies of the antenna must be taken into account when designing the radome. Depending on the layer thickness of the radome wall or of individual layers of the wall, it can occur that the radome is not transparent to particular frequencies and that a different radome must be used for corresponding working frequencies.

SUMMARY OF THE EMBODIMENTS

Embodiments of the invention can be considered to be the specification of a radome which offers good electromagnetic transparency with increased mechanical stability, so that an electromagnetic signal is distorted or, in particular, attenuated to the least possible extent, or not at all, upon passing through the radome.

According to a first aspect, a radome is specified for shielding a transmitter/receiver unit. The radome comprises a wall with a core layer, a first cover layer and a second cover layer. The first cover layer and the core layer are arranged such that a surface of the first cover layer is, at least in sections, adjacent to a first surface of the core layer. The second cover layer and the core layer are arranged such that a surface of the second cover layer is, at least in sections, adjacent to a second surface of the core layer. The core layer is thereby arranged between the first cover layer and the second cover layer. The first cover layer and the core layer are mechanically connected to one another. The second cover layer and the core layer are mechanically connected to one another. The first cover layer comprises a first partial layer, a second partial layer and a third partial layer, wherein the first partial layer is arranged such that it forms a first surface of the wall, and wherein the second partial layer is arranged between the first partial layer and the third partial layer. Both the first partial layer and also the third partial layer thereby respectively have a higher dielectric constant than the second partial layer. Like the first cover layer, the second cover layer comprises a first partial layer, a second partial layer and a third partial layer, wherein the first partial layer is arranged such that it forms a second surface of the wall, and wherein the second partial layer is arranged between the first partial layer and the third partial layer. Both the first partial layer and also the third partial layer thereby have respectively a higher dielectric constant than the second partial layer A radome of this type provides high mechanical stability and high transparency to electromagnetic waves. The individual partial layers of the cover layers can respectively be embodied in a thinner manner and still provide high mechanical resistance in that one cover layer each is arranged on two opposing sides of the core layer.

A radome can, e.g., be embodied in the shape of a bell and comprise an essentially U-shaped or V-shaped cross section, which means that the wall is curved, for example, arched or bent by approximately 180°. The radome thus forms an accommodation space for a transmitter/receiver unit or antenna.

The shielding function of a radome refers to the shielding against mechanical and chemical environmental influences on an antenna. In particular, the aforementioned shielding does not refer to the permeability of the radome to electromagnetic waves, i.e., the radome should ideally be transparent to electromagnetic waves so that an antenna arranged under the radome can perform its function.

The first cover layer can form the outer side of the wall, and the second cover layer can form the inner side of the wall. The inner side faces a radome of the antenna, which radome is embodied in a bell shape. The outer side faces away from the antenna or the accommodation space. Both the first cover layer and also the second cover layer also each form a respective surface of the wall with one of their surfaces.

The mechanical resistance of the radome refers to two aspects. On the one hand, a rigidity that reduces a deformation of the radome is achieved through the structure of the core layer and of the two cover layers and, on the other hand, a radome of this type can provide stability against the ingress of a fluid located outside of the radome, in particular of liquids or gases, or of foreign objects into the radome, or against the penetration or breaking-through of the wall by foreign objects in motion relative to the radome. In particular, the mechanical resistance can include the aspects of rigidity (low deformation under load) and stability (mechanical structure is only destroyed when a threshold value of the load is exceeded).

If the radome is arranged on an outer surface of a vehicle, e.g., on a watercraft or on an aircraft, the radome is moved relative to the surrounding environment of the vehicle during travel, and collisions with foreign objects from the surrounding environment of the vehicle can occur. In the case of aircraft, this can be a bird strike, for example. In order to prevent damage to the antenna, a radome must be embodied such that it withstands corresponding stresses. These stresses can in particular be point stresses caused by foreign objects. In particular, a radome may also be exposed to air contact pressure, which can lead to a mechanical stressing of the entire radome and can exert deformation energy on the wall of the radome.

The wall of the radome can be embodied as a planar wall and cover an opening in an outer wall of a vehicle, wherein an antenna can be arranged in this opening.

Both cover layers are mechanically connected to the core layer. This connection can be a direct connection of the cover layers to the core layer, e.g., by a materially bonded connection in the form of an adhesive connection, for example. In this case, direct connection means that a surface of a cover layer is connected to a surface of the core layer that is directly adjacent to this surface of the cover layer.

The partial layers of the two cover layers are adjacent to one another and can be connected to one another on surfaces adjacent to one another, for example, by a materially bonded connection in the form of an adhesive connection, for example.

The partial layers of each cover layer are positioned on top of one another in a direction perpendicular to the wall. The cover layers and the core layer are also positioned on top of one another in a direction perpendicular to the wall, wherein the core layer is arranged between the first cover layer and the second cover layer.

The first cover layer is divided into multiple partial layers. The plurality of these partial layers can thereby be particularly arranged such that adjacent partial layers comprise dielectric constants which differ from one another. In particular, the partial layers can be arranged such that the relative change in the dielectric constants of adjacent partial layers alternates, which means that, starting from a partial layer with a high dielectric constant (the first partial layer of the first cover layer or the second cover layer), a directly adjacent partial layer with a lower dielectric constant follows (second partial layer of the two cover layers), and vice versa. In this transition between the first partial layer and second partial layer, the dielectric constant decreases. In the transition from the second partial layer to the third partial layer, the dielectric constant increases, which means that the dielectric constant of the third partial layer is higher than the dielectric constant of the second partial layer. This basic structure can be referred to as an alternating dielectric constant relationship of adjacent partial layers.

The radome as described above and below allows for use with multiple frequencies. In particular, it can be adapted such that the partial layers are transparent to high transmission frequencies. Under this condition, the radome is also transparent to lower frequencies, so that the radome can, without constructive adaptations, be used to shield antennas that use different frequencies.

The dielectric constants of the partial layers, cover layers and of the core layer can in particular be determined with identical ambient conditions, especially at an identical ambient temperature and an identical temperature of the respective partial layers, cover layers or the core layer.

According to one embodiment, the first partial layer of the first cover layer is directly adjacent to the second partial layer of the first cover layer.

According to further embodiment, the third partial layer of the first cover layer is directly adjacent to the second partial layer of the first cover layer.

According to a further embodiment, the first partial layer of the first cover layer has a lower dielectric constant than the third partial layer of the first cover layer.

According to a further embodiment, the first partial layer of the first cover layer has a layer thickness that is greater than the layer thickness of the third partial layer of the first cover layer or equal to the layer thickness of the third partial layer of the first cover layer.

The first cover layer can in particular be designed to absorb local mechanical stresses caused by foreign objects which strike the wall. The first partial layer can therefore have a greater layer thickness than the third partial layer.

According to a further embodiment, the first cover layer comprises a fourth partial layer which is arranged between the third partial layer of the first cover layer and the core layer, wherein the fourth partial layer of the first cover layer has a lower dielectric constant than the first partial layer of the first cover layer and a lower dielectric constant than the third partial layer of the first cover layer.

According to a further embodiment, the first cover layer comprises a fifth partial layer which is arranged between the fourth partial layer and the core layer, wherein the fifth partial layer has a higher dielectric constant than the second partial layer of the first cover layer and a higher dielectric constant than the fourth partial layer of the first cover layer.

The first cover layer is thus structured such that the partial layers have an alternating dielectric constant relationship. In this manner, a greatest possible electromagnetic transparency can be achieved with a greatest possible mechanical stability.

The first cover layer is divided into multiple partial layers. Because of this physical characteristic, the partial layers with a low dielectric constant have hardly any effect on the electromagnetic wave passing through the radome.

In principle, the partial layers with a higher dielectric constant can have an effect on an electromagnetic wave. However, in order to reduce this effect, the partial layers with a high dielectric constant are nevertheless reduced in terms of their layer thickness to such an extent that this layer thickness does not exceed one-sixteenth of a wavelength of the electromagnetic wave sent or received by the antenna. If this condition is met, a partial layer with such a layer thickness is transparent to a corresponding electromagnetic wave and does not affect the amplitude or the phase of this electromagnetic wave.

In particular, the partial layers with a high dielectric constant provide a necessary mechanical stability of the radome, whereas the division of the cover layers into multiple partial layers having alternating dielectric constant relationships enables the electromagnetic transparency of the radome.

According to a further embodiment, at least one partial layer of the first partial layer, the third partial layer and the fifth partial layer of the first cover layer has a layer thickness less than, or at most equal to, at least one partial layer of the second partial layer and the fourth partial layer of the first cover layer.

In other words, the partial layers with a high dielectric constant are at most equally thick or thinner than the partial layers with a low dielectric constant. From the relationship described above between layer thickness and wavelength of a penetrating electromagnetic wave, as well as the effect of this partial layer on the parameters of the electromagnetic wave, it follows that with an increasing frequency of an electromagnetic wave (that is, with a decreasing wavelength), the partial layers with a high dielectric constant must be increasingly thinner in order to be electromagnetically transparent (wavelength/16). Thus, the thinner the partial layers with a high dielectric constant, the higher the frequencies that can be transmitted without the radome sacrificing its electromagnetic transparency therefor.

According to a further embodiment, the first partial layer of the first cover layer has a layer thickness between 0.05 mm and 2 mm, in particular between 0.05 mm and 0.5 mm, and more particularly between 0.10 mm and 0.4 mm.

As a result, electromagnetic waves with a frequency, for example, of 5 GHz or higher, for instance, 40 GHz, can be transmitted, and the first partial layer is electromagnetically transparent thereto. Likewise, the other partial layers of the first cover layer and the second cover layer are electromagnetically transparent to a corresponding signal.

According to a further embodiment, the second partial layer of the first cover layer has a layer thickness between 1 mm and 2 mm.

Since the second partial layer has a lower dielectric constant than the first partial layer, the second partial layer therefore already has little or hardly any effect on the parameters of an electromagnetic wave. Thus, the layer thickness of the second partial layer is of little relevance when considering the electromagnetic transparency of the first cover layer.

According to a further embodiment, the second cover layer is structured mirror-symmetrically to the first cover layer, wherein the core layer is considered to be the axis of symmetry.

The first partial layer of the first cover layer is arranged facing away from the core layer, that is, it points outwards in relation to the wall (away from the core layer) and outwards in relation to the radome (away from the antenna). The first partial layer of the second cover layer points outwards in relation to the wall (away from the core layer) and inwards in relation to the radome (in the direction of the antenna).

According to a further embodiment, the core layer has a layer thickness between 10 mm and 50 mm.

The core layer and the partial layers with a, relatively speaking, low dielectric constant can in particular achieve a rigidity against a deformation of the radome. Since the core layer and the partial layers with a low dielectric constant are electromagnetically transparent or at least nearly transparent, the layer thickness thereof can also be higher than the wavelength/16 condition, which applies to the partial layers with a high dielectric constant.

According to a further embodiment, the core layer has a lower dielectric constant than the first partial layer of the first cover layer.

According to a further embodiment, the first partial layer of the first cover layer and/or of the second cover layer comprises a fiber structure embedded in a matrix, e.g., in the form of a fiber fabric impregnated with resin, in particular, synthetic resin.

According to a further embodiment, the resin-impregnated fibers are glass fibers.

The glass fibers can, e.g., comprise S-2 glass, quartz glass, E-glass. Other useable fiber types are, e.g., Kevlar or basalt.

The third partial layer and the fifth partial layer of the first and second cover layer can comprise the same materials as the first partial layer.

According to a further embodiment, the second partial layer and the fourth partial layer of the two cover layers comprise a phenoplast.

The second and the fourth partial layer can be embodied as a honeycomb structure. Alternatively, these partial layers can comprise a planar material that extends in a wave-shaped manner between the respectively adjacent partial layers, so that the respective wave peaks or wave troughs are adjacent to the neighboring layers opposing one another. Alternatively, these two partial layers can also be embodied in a knob-shaped manner, wherein the knobs extend between the adjacent partial layers. Alternatively, these two partial layers can be embodied as a spatially arranged framework grid. These partial layers can alternatively contain a foam or be formed from a foam. These partial layers comprise openings or air inclusions which can keep the dielectric constant of these partial layers low.

The second and the fourth partial layers can also be embodied as combinations of materials that were described as alternatives above.

According to a further aspect, an aircraft is specified having a radome as described above and below. The radome can be arranged on the aircraft in a nose region, that is, at the fore in the direction of flight.

Alternatively, the radome can also be arranged on any other outer surface of a vehicle. In particular, an intended emitting direction and/or receiving direction of the antenna can be decisive for the positioning of the antenna and of the radome.

The structure of the radome provides high mechanical rigidity and stability, which can be an important precondition of use, especially in the nose region of an aircraft, as well as high electromagnetic transparency.

Embodiments of the invention are directed to a radome for shielding a transmitter/receiver unit that includes a wall having a core layer, a first cover layer and a second cover layer arranged so that the first cover layer and the core layer and the second cover layer and core layer are mechanically connected to one another in such a manner that the core layer is arranged between the first cover layer and the second cover layer. The first cover layer and the core layer are arranged such that a surface of the first cover layer is, at least in sections, adjacent to a first surface of the core layer, and the second cover layer and the core layer are arranged such that a surface of the second cover layer is, at least in sections, adjacent to a second surface of the core layer. The first cover layer includes at least a first partial layer, a second partial layer and a third partial layer, the first partial layer being arranged such that it forms a first surface of the wall, the second partial layer being arranged between the first partial layer and the third partial layer, and the first partial layer and the third partial layer having higher dielectric constants than that of the second partial layer. The second cover layer includes at least a first partial layer, a second partial layer and a third partial layer, the first partial layer being arranged such that it forms a second surface of the wall, the second partial layer being arranged between the first partial layer and the third partial layer, and the first partial layer and the third partial layer having higher dielectric constants than that of the second partial layer.

In embodiments, the first partial layer of the first cover layer can be directly adjacent to the second partial layer of the first cover layer.

According to embodiments, the third partial layer of the first cover layer can be directly adjacent to the second partial layer of the first cover layer.

In accordance with embodiments, the first partial layer of the first cover layer may have a dielectric constant that is equal to or less than the third partial layer of the first cover layer.

In other embodiments, the first partial layer of the first cover layer can have a layer thickness that is greater than or equal to the layer thickness of the third partial layer of the first cover layer.

According to further embodiments, the first cover layer can further include a fourth partial layer that may be arranged between the third partial layer of the first cover layer and the core layer, the fourth partial layer of the first cover layer having a lower dielectric constant than that of the first partial layer of the first cover layer and a lower dielectric constant than that of the third partial layer of the first cover layer. The first cover layer further includes a fifth partial layer which can be arranged between the fourth partial layer and the core layer, the fifth partial layer having a higher dielectric constant than that of the second partial layer of the first cover layer and a higher dielectric constant than that of the fourth partial layer of the first cover layer. At least one of the first partial layer, the third partial layer and the fifth partial layer of the first cover layer can have a layer thickness less than or equal to at least one of the second partial layer and the fourth partial layer of the first cover layer.

In accordance with embodiments of the invention, the first partial layer of the first cover layer may have a layer thickness between 0.05 mm and 2 mm.

According to embodiments, the second partial layer of the first cover layer can have a layer thickness between 1 mm and 2 mm.

Further, the second cover layer may be structured in a mirror-symmetrical manner to the first cover layer, in relation to the core layer as an axis of symmetry.

In other embodiments, the core layer can include a layer thickness between 10 mm and 50 mm.

According to still other embodiments, the core layer may have a lower dielectric constant than the first partial layer of the first cover layer.

Embodiments of the invention are directed to a method of forming a wall of a radome for shielding a transmitter/receiver unit. The method includes mechanically connecting, at least in sections, a surface of a first cover layer to a first surface of a core layer and, at least in sections, a surface of a second cover layer to a second surface of the core layer so that the core layer is arranged between the first cover layer and the second cover layer; forming the first cover layer from at least a first partial layer, a second partial layer and a third partial layer, the first partial layer being arranged such that it forms a first surface of the wall, the second partial layer being arranged between the first partial layer and the third partial layer, and the first partial layer and the third partial layer having higher dielectric constants than that of the second partial layer; and forming the second cover layer from at least a first partial layer, a second partial layer and a third partial layer, the first partial layer being arranged such that it forms a second surface of the wall, the second partial layer being arranged between the first partial layer and the third partial layer, and the first partial layer and the third partial layer having higher dielectric constants than that of the second partial layer.

In accordance with embodiments, the first partial layer of the first cover layer can be directly adjacent to the second partial layer of the first cover layer, and the third partial layer of the first cover layer is directly adjacent to the second partial layer of the first cover layer.

According to other embodiments, a dielectric constant of the first partial layer of the first cover layer may be less than or equal to a dielectric constant of the third partial layer of the first cover layer.

In accordance with other embodiments, a layer thickness of the first partial layer of the first cover layer can be greater than or equal to the layer thickness of the third partial layer of the first cover layer.

According to still other embodiments, the first partial layer of the first cover layer can have a layer thickness between 0.05 mm and 2 mm.

In embodiments of the present invention, the second partial layer of the first cover layer can have a layer thickness between 1 mm and 2 mm.

In accordance with still yet other embodiments of the present invention, the core layer comprises a layer thickness between 10 mm and 50 mm.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
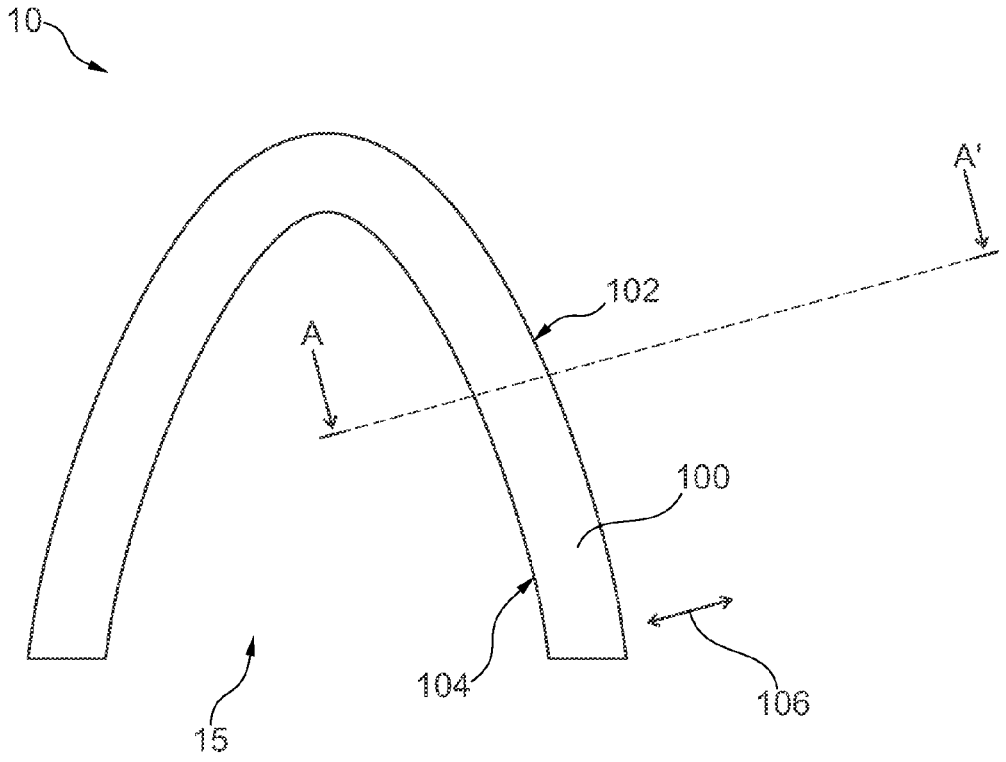
FIG. 1 shows a schematic illustration of a radome according to an exemplary embodiment.

FIG. 1 shows a sectional illustration of a radome 10. The cross section is essentially U-shaped or V-shaped, so that an accommodation space 15 is formed by the wall 100. The wall 100 comprises a first, outer surface 102 and a second, inner surface 104. The first surface 102 and the second surface 104 oppose one another in a direction 106 crosswise through the wall 100.

Figure 2:
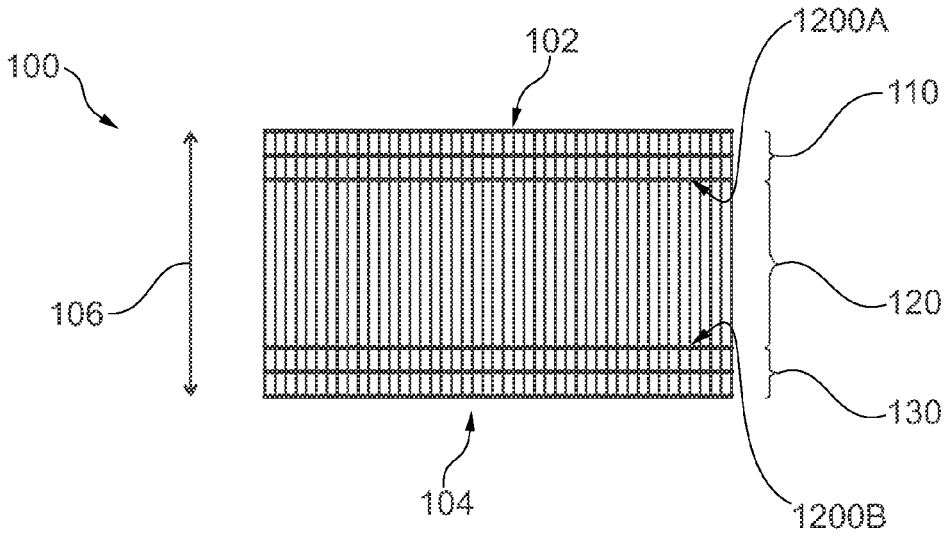
FIG. 2 shows a schematic illustration of the cross section of a wall of a radome according to a further exemplary embodiment.

FIG. 2 shows a cross-section along the sectional line A-A' from FIG. 1. From surface 102 in the direction 106 towards surface 104, core layer 120 is positioned between first cover layer 110 and second cover layer 130.

First cover layer 110 bears against a surface 1200A of core layer 120. Second cover layer 130 bears against a surface 1200B of core layer 120. Surfaces 1200A, 1200B, and therefore also cover layers 110, 130 are arranged opposite of one another.

Both cover layers 110, 130 are mechanically connected to the core layer 120. This connection can be, e.g., a direct connection of cover layers 110, 130 to core layer 120 by way of a materially bonded connection in the form of, e.g., an adhesive connection. In this case, direct connection means that a surface of a cover layer 110 and/or 130 is connected to a surface 1200A and/or 1200B of core layer 120 that is directly adjacent to this surface of cover layer 110 and/or 130. In embodiments, core layer 120 has a layer thickness between 10 mm and 50 mm.

Figure 3:
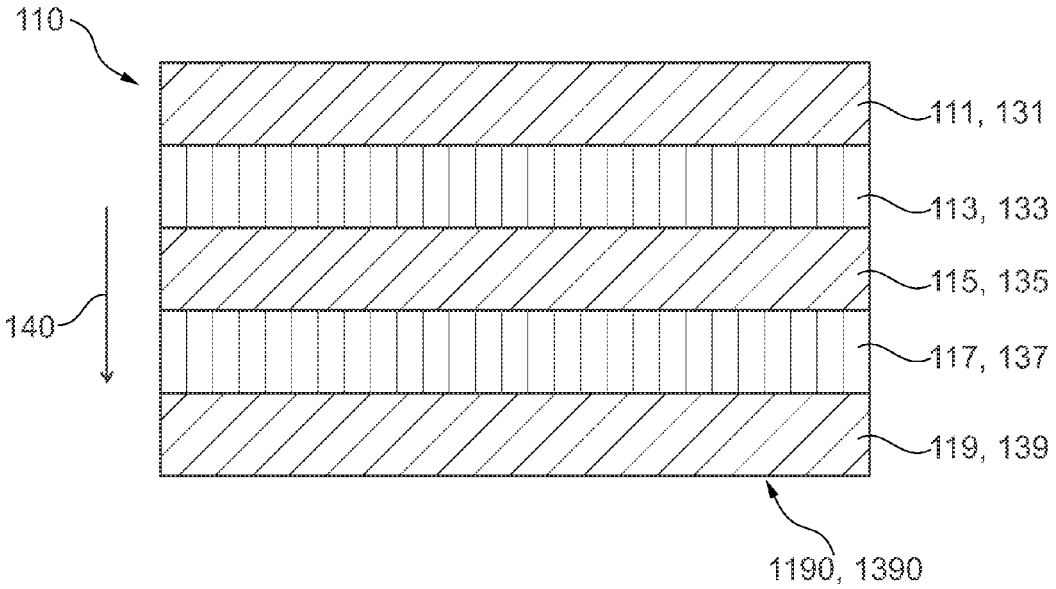
FIG. 3 shows a schematic illustration of a cover layer according to a further exemplary embodiment.

Cover layers 110, 130 comprise respectively a plurality of partial layers, as is shown in detail in FIG. 3.

FIG. 3 shows a schematic illustration of cover layer 110. Cover layer 130 can essentially be structured in an identical manner.

Partial layers 111, 113, 115, 117 and 119 and partial layer 131, 133, 135, 137 and 139 are arranged on top of one another in direction 140 of increasing material depth, i.e., towards core layer 120.

First partial layer 111, 131 has a higher dielectric constant than second partial 113, 133. Second partial layer 113, 133 has a lower dielectric constant than third partial layer 115, 135. Third partial layer 115, 135 has a higher dielectric constant than fourth partial layer 117, 137. Fourth partial layer 117, 137 has a lower dielectric constant than fifth partial layer 119, 139. Thus, first cover layer 110 is structured so that partial layers 111, 113, 115, 117 and 119 have an alternating dielectric constant relationship. In this manner, a greatest possible electromagnetic transparency can be achieved with a greatest possible mechanical stability.

In principle, the partial layers 111, 115, 119 and 131, 135, 139 with a higher dielectric constant can have an effect on an electromagnetic wave. However, in order to reduce this effect, the partial layers 111, 115, 119 and 131, 135, 139 with a high dielectric constant are nevertheless reduced in terms of their layer thickness to such an extent that this layer thickness does not exceed one-sixteenth of a wavelength of the electromagnetic wave sent or received by the antenna. If this condition is met, a partial layer with such a layer thickness is transparent to a corresponding electromagnetic wave and does not affect the amplitude or the phase of this electromagnetic wave.

In particular, the partial layers 111, 115, 119 and 131, 135, 139 with a high dielectric constant provide a necessary mechanical stability of the radome, whereas the division of cover layers 110, 130 into multiple partial layers having alternating dielectric constant relationships enables the electromagnetic transparency of the radome. In particular, because of this physical arrangement of first cover layer 110, partial layers 113, 117 with a low dielectric constant have hardly any effect on the electromagnetic wave passing through the radome. In embodiments, second and fourth partial layer 113, 117 can be embodied as a honeycomb structure. Alternatively, these partial layers 113, 117 can comprise a planar material that extends in a wave-shaped manner between the respectively adjacent partial layers 111, 115, 119, so that the respective wave peaks or wave troughs are adjacent to the neighboring layers 111, 115, 119 opposing one another. Alternatively, these two partial layers 113, 117 can also be embodied in a knob-shaped manner, wherein the knobs extend between the adjacent partial layers 111, 115, 119. Alternatively, these two partial layers 113, 117 can be embodied as a spatially arranged framework grid. These partial layers 113, 117 can alternatively contain a foam or be formed from a foam. These partial layers 113, 117 comprise openings or air inclusions which can keep the dielectric constant of these partial layers low.

In exemplary embodiments, first partial layer 111 of first cover layer 110 has a layer thickness between 0.05 mm and 2 mm, in particular between 0.05 mm and 0.5 mm, and more particularly between 0.10 mm and 0.4 mm. As a result, electromagnetic waves with a frequency of, e.g., 5 GHz or higher, for instance, 40 GHz, can be transmitted, and first partial layer 111 is electromagnetically transparent thereto. Likewise, the other partial layers 113, 115, 117, 119 of first cover layer 110 and second cover layer 130 are electromagnetically transparent to a corresponding signal. In embodiments, second partial layer 113 of first cover layer 110 has a layer thickness between 1 mm and 2 mm. Because second partial layer 113 has a lower dielectric constant than first partial layer 111, second partial layer 113 therefore already has little or hardly any effect on the parameters of an electromagnetic wave. Thus, the layer thickness of the second partial layer 113 is of little relevance when considering the electromagnetic transparency of first cover layer 110.

In embodiments, cover layer 110, 130 can also comprise more than five partial layers. Additional partial layers can thereby be added such that they are added on surface 1190, 1390 that faces core layer 120. If additional partial layers are added, then this can occur in particular while satisfying the requirement for the alternating dielectric constant relationships, i.e., a partial layer with a higher dielectric constant can be added after a partial layer with a relatively low dielectric constant, and vice versa.

Partial layers 111, 113, 115, 117 and 119 and 131, 133, 135, 137 and 139 of the two cover layers 110, 130 are adjacent to one another and can be connected to one another on surfaces adjacent to one another, for example, by a materially bonded connection, e.g., in the form of an adhesive connection.

Partial layers 111, 113, 115, 117 and 119 of cover layer 110 and partial layer 131, 133, 135, 137 and 139 of cover layer 130 are positioned on top of one another in a direction crosswise to wall 100. Cover layers 110, 130 and core layer 120 are also positioned on top of one another in a direction crosswise to wall 100, wherein core layer 120 is arranged between first cover layer 110 and second cover layer 130.

Figure 4:
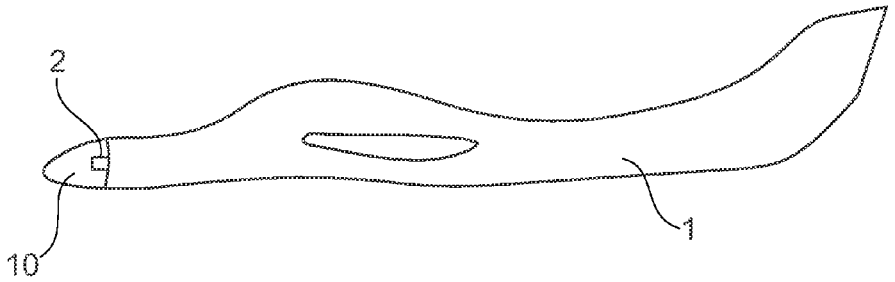
FIG. 4 shows a schematic illustration of an aircraft according to a further exemplary embodiment.

FIG. 4 shows a schematic illustration of an aircraft 1 which, in the region of the nose, comprises an antenna 2 that is protected against environmental influences by a radome 10.

The extension of a partial layer in the direction of the arrow 140 is referred to as the layer thickness.

The radome herein described allows for use with multiple frequencies. In particular, the radome can be adapted such that the partial layers are transparent to high transmission frequencies. Under this condition, the radome is also transparent to lower frequencies, so that the radome can, without constructive adaptations, be used to shield antennas that use different frequencies.

The dielectric constants of the partial layers 111, 113, 115, 117 and 119 and 131, 133, 135, 137 and 139, cover layers 110, 130 and of the core layer 120 can in particular be determined with identical ambient conditions, especially at an identical ambient temperature and an identical temperature of the respective partial layers 111, 113, 115, 117 and 119 and 131, 133, 135, 137 and 139, cover layers 110, 130 and of the core layer 120.

As discussed above, the mechanical resistance of the radome refers to two aspects. On the one hand, a rigidity that reduces a deformation of the radome is achieved through the structure of the core layer 120 and of the two cover layers 110, 130 and, on the other hand, a radome of this type can provide stability against the ingress of a fluid located outside of the radome, in particular of liquids or gases, or of foreign objects into the radome, or against the penetration or breaking-through of the wall by foreign objects in motion relative to the radome. In particular, the mechanical resistance can include the aspects of rigidity (low deformation under load)

and stability (mechanical structure is only destroyed when a threshold value of the load is exceeded).

Thus, first cover layer 110 can be designed, e.g., to absorb local mechanical stresses caused by foreign objects which strike wall 100. The first partial layer 111 can therefore have a greater layer thickness than third partial layer 115.

If the radome is arranged on an outer surface of a vehicle, such as an aircraft (as shown in the embodiment of FIG. 4), the radome is moved relative to the surrounding environment of the vehicle during travel, and collisions with foreign objects from the surrounding environment of the vehicle can occur. In the case of the illustrated embodiment, this can be, e.g., a bird strike. In order to prevent damage to the antenna, a radome must be embodied such that it withstands corresponding stresses. These stresses can in particular be point stresses caused by foreign objects. In particular, a radome may also be exposed to air contact pressure, which can lead to a mechanical stressing of the entire radome and can exert deformation energy on the wall of the radome. Of course, it is contemplated that the radome can also be arranged on an outside surface of a watercraft without departing from the spirit and scope of the embodiments.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A radome for shielding a transmitter/receiver unit, comprising:

a wall forming a window portion having a core layer, a first cover layer and a second cover layer arranged so that the first cover layer and the core layer and the second cover layer and core layer are mechanically connected to one another in such a manner that the core layer is arranged between the first cover layer and the second cover layer, wherein the first cover layer and the core layer are arranged such that a surface of the first cover layer is, at least in sections, adjacent to a first surface of the core layer, and the second cover layer and the core layer are arranged such that a surface of the second cover layer is, at least in sections, adjacent to a second surface of the core layer, wherein the first cover layer comprises at least a first partial layer, a second partial layer and a third partial layer, the first partial layer being arranged such that it forms a first surface of the wall, the second partial layer being arranged between the first partial layer and the third partial layer, and the first partial layer and the third partial layer having higher dielectric constants than that of the second partial layer, and wherein the second cover layer comprises at least a fourth partial layer, a fifth partial layer and a sixth partial layer, the fourth partial layer being arranged such that it forms a second surface of the wall, the fifth partial layer being arranged between the fourth partial layer and the sixth partial layer, and the fourth partial layer and the sixth partial layer having higher dielectric constants than that of the fifth partial layer.

2. The radome according to claim 1, wherein the first partial layer of the first cover layer is directly adjacent to the second partial layer of the first cover layer.

3. The radome according to claim 1, wherein the third partial layer of the first cover layer is directly adjacent to the second partial layer of the first cover layer.

4. The radome according to claim 1, wherein the first partial layer of the first cover layer has a dielectric constant that is equal to or less than the third partial layer of the first cover layer.

5. The radome according to claim 1, wherein the first partial layer of the first cover layer has a layer thickness that is greater than or equal to the layer thickness of the third partial layer of the first cover layer.

6. The radome according to claim 1, wherein the first cover layer further comprises a seventh partial layer that is arranged between the third partial layer of the first cover layer and the core layer, the seventh partial layer of the first cover layer having a lower dielectric constant than that of the first partial layer of the first cover layer and a lower dielectric constant than that of the third partial layer of the first cover layer.

7. The radome according to claim 6, wherein the first cover layer further comprises an eighth partial layer which is arranged between the seventh partial layer and the core layer, the eighth partial layer having a higher dielectric constant than that of the second partial layer of the first cover layer and a higher dielectric constant than that of the seventh partial layer of the first cover layer.

8. The radome according to claim 7, wherein at least one of the first partial layer, the third partial layer and the fifth partial layer of the first cover layer has a layer thickness less than or equal to at least one of the second partial layer and the fourth partial layer of the first cover layer.

9. The radome according to claim 1, wherein the first partial layer of the first cover layer has a layer thickness between 0.05 mm and 2 mm.

10. The radome according to claim 1, wherein the second partial layer of the first cover layer has a layer thickness between 1 mm and 2 mm.

11. The radome according to claim 1, wherein the second cover layer is structured mirror-symmetrical manner to the first cover layer, in relation to the core layer as an axis of symmetry.

12. The radome according to claim 1, wherein the core layer comprises a layer thickness between 10 mm and 50 mm.

13. The radome according to claim 1, wherein the core layer has a lower dielectric constant than the first partial layer of the first cover layer.

14. A method of forming a wall of a radome for shielding a transmitter/receiver unit, the method comprising:

mechanically connecting, at least in sections, a surface of a first cover layer to a first surface of a core layer and, at least in sections, a surface of a second cover layer to a second surface of the core layer so that the core layer is arranged between the first cover layer and the second cover layer;

forming the first cover layer from at least a first partial layer, a second partial layer and a third partial layer, the first partial layer being arranged such that it forms a first surface of the wall, the second partial layer being arranged between the first partial layer and the third partial layer, and the first partial layer and the third partial layer having higher dielectric constants than that of the second partial layer; and forming the second cover layer from at least a fourth partial layer, a fifth partial layer and a sixth partial layer, the fourth partial layer being arranged such that it forms a second surface of the wall, the fifth partial layer being arranged between the fourth partial layer and the sixth partial layer, and the fourth partial layer and the sixth partial layer having higher dielectric constants than that of the fifth partial layer, wherein the wall forms a window portion of the radome.

15. The method according to claim 14, wherein the first partial layer of the first cover layer is directly adjacent to the second partial layer of the first cover layer, and wherein the third partial layer of the first cover layer is directly adjacent to the second partial layer of the first cover layer.

16. The method according to claim 14, wherein a dielectric constant of the first partial layer of the first cover layer is less than or equal to a dielectric constant of the third partial layer of the first cover layer.

17. The method according to claim 14, wherein a layer thickness of the first partial layer of the first cover layer is greater than or equal to the layer thickness of the third partial layer of the first cover layer.

18. The method according to claim 14, wherein the first partial layer of the first cover layer has a layer thickness between 0.05 mm and 2 mm.

19. The method according to claim 14, wherein the second partial layer of the first cover layer has a layer thickness between 1 mm and 2 mm.

20. The method according to claim 14, wherein the core layer comprises a layer thickness between 10 mm and 50 mm.

* * * * *